US005259435A

United States Patent [19]

Miura et al.

[11] Patent Number: 5,259,435

[45] Date of Patent: Nov. 9, 1993

[54] LIGHTWEIGHT AND LOW THERMAL EXPANSION COMPOSITE MATERIAL

[75] Inventors: Hirohisa Miura, Okazaki; Masaoki Hashimoto; Mamoru Okamoto, both of Aichi; Shoichi Tsuchiya, Toyota; Wataru Yagi, Nagoya; Masami Ishii, Toyota, all of Japan

[73] Assignees: Toyota Jidosha Kabushiki Kaisha, Toyota; Aisin Seiki Kabushiki Kaisha, Kariya, both of Japan

[21] Appl. No.: 620,855

[22] Filed: Dec. 3, 1990

[30] Foreign Application Priority Data

Dec. 4, 1989 [JP] Japan ..... 1-314847

[51] Int. Cl.[5] ..... B22D 7/04; B32B 5/16

[52] U.S. Cl. ..... 164/97; 428/325; 428/329; 428/332; 428/406; 428/433

[58] Field of Search ..... 428/325, 329, 332, 404, 428/406, 426, 433, 688, 689, 344, 34.5, 35.7, 472, 472.2; 427/217, 431, 443.2; 164/97

[56] References Cited

U.S. PATENT DOCUMENTS 4,340,109 7/1982 Roddy ..... 164/97
4,568,603 2/1986 Oldham ..... 428/195
4,621,024 11/1986 Wright ..... 428/404
4,739,817 4/1988 Hamajima et al. ..... 164/97
4,907,780 2/1990 Sasaki et al. ..... 164/4.1
4,939,038 7/1990 Inabata et al. ..... 428/402
5,007,474 4/1991 Langensiepen et al. ..... 164/97

FOREIGN PATENT DOCUMENTS 19411 6/1976 Japan .

*Primary Examiner*—Paul J. Thibodeau
*Assistant Examiner*—Hoa T. Lê
*Attorney, Agent, or Firm*—Finnegan, Henderson, Farabow, Garrett & Dunner

[57] ABSTRACT

A method of forming a metallic composite product having a specific gravity no greater than 1.8 and a thermal expansion no greater than $16\times10^{-6}$° C. in a preheated mold. The portion of the mold between a cavity and the gate has a stainless steel wire gauge for retaining particles. The mold is filled with screened fly ash, glass, hollow spheres having a particle size in the range of 50 to 200 micrometers and a globularness of at least 90%, which has been preheated to the same temperature as the mold. Molten aluminum alloy is injected into the mold at a pressure in the range of from 40 to 80 kgf cm$^2$ at the gate and at a flow velocity in the range of 0.08 to 0.20 m/second.

5 Claims, 7 Drawing Sheets

(X 100)

LIGHTWEIGHT AND LOW THERMAL EXPANSION COMPOSITE MATERIAL

BACKGROUND OF THE INVENTION

1. Field of the Invention

The present Invention relates to a lightweight and low thermal expansion composite material. The composite material of the present invention can be utilized for an automobile, an aircraft and the like, and it is especially suitable for making a pump rotor of a supercharger for an automobile.

2. Description of the Prior Art

A lightweight and low thermal expansion composite material as disclosed in Japanese Examined Patent Publication (KOUKC)KU) No. 19411/1976 has been proposed. The composite material includes a homogeneously dispersed mixture including "shirasu" balloons, aluminum, zinc and tin, or an alloy made mainly of these metals. The "shirasu" balloons have a particle size falling within a range of 30–600 micrometers.

In general, this lightweight and low thermal expansion composite material is produced as follows. First, a "shirasu" balloon aggregate is formed by closely filling up a mold with "shirasu" balloons which have a particle size falling within an appropriate range. After forming the "shirasu" balloon aggregate, the mold is depressurized and a molten metal is introduced and forced into the interstices between the "shirasu" balloons of the aggregate by atmospheric pressure.

The above-mentioned "shirasu" balloons are produced from volcanic ash. The "shirasu" balloons are minute hollow particles and generally have irregular shapes. Because the "shirasu" balloons are not uniform in shape it is hard to fill up a mold closely or densely and evenly or uniformly with the "shirasu" balloons. Therefore, there is a limitation to increase a volume content of the "shirasu" balloons in the conventional lightweight and low thermal expansion composite material. Accordingly, there are limitations to a further lightweight the conventional decrease in weight of and low thermal expansion composite material made of the "shirasu" balloons, and to further making the material less likely to expand. Additionally, there is another problem that it takes a lot of time to fill up a mold with the "shirasu" balloons, thereby resulting in decreased production efficiency.

Further, the particle size of the "shirasu" balloons influences greatly the physical properties of the conventional lightweight and low thermal expansion composite material. When the particle size of the "shirasu" balloons is too large, the strength of the composite material decreases significantly. In addition, the "shirasu" balloons having a large particle size usually have an uneven shell thickness; and therefore, they are more likely to fracture due to stress concentration during molding. Accordingly, the light alloy particles are not disposed uniformly in the interstices between the "shirasu" balloons, thereby making the physical properties of the conventional composite material less uniform. On the other hand, when the particle size of the "shirasu" balloons is too small, molten metal flowability decreases thereby resulting in a prolonged molding time.

SUMMARY OF THE INVENTION

The present invention has been developed in view of the above-mentioned circumstances. It is therefore an object of the present invention to provide a lightweight and low thermal expansion composite material which is light in weight and less likely to expand without adversely affecting its practical high strength.

It is another object of the present invention to provide a lightweight and low thermal expansion composite material which permits excellent production efficiency during molding of a product.

The above and other object of the present invention can be achieved by a lightweight and low thermal expansion composite material according to the present invention. The composite material comprises a homogeneously dispersed mixture having a specific gravity of 1.8 or less and a thermal expansion coefficient of $16\times10^{-6}/°$ C. or less, the homogeneously dispersed mixture including at least glass balloons having a particle size falling within a range of 50–200 micrometers, and a globularness of 90% or more, and a light alloy.

The lightweight and low thermal expansion composite material according to the present invention is produced as follows. A glass balloon aggregate is formed by filling up a mold with glass spheres. A molten metal is introduced and forced into the interstices between the glass spheres aggregate by a presser device pressurizing method, a compressor pressurizing method, and a decompressing depressurizing method or the like. After the molten metal has penetrated through and dispersed uniformly in the interstices, the molten metal is solidified to produce the composite material. Here, a molten metal mixing method or a powder mixing method may be used, in which a molten light or, a light alloy powder, and glass balloons are directly mixed together.

In general, glass balloons are hollow spheres (perlite balloons and "shirasu" balloons) expanded by burning rapidly glassy volcanic rocks, hollow spheres expanded by burning clay or shale, which are expansible during burning, or hollow spheres ("micro" balloons) expanded by burning borosilicate glass, and the like. Coal ash (fly ash) generated by a thermal power plant and slag generated from a blast furnace have an expanding property during burning. The hollow spheres obtained from fly ash are commercially available. Though electromelting bubbles (zirconia bubbles and alumina bubbles), which are produced artificially, are desirable because they have a substantially sphere-like shape and are lightweight, they are expensive. In the present invention, as the glass balloons, it preferable to classify and use glass spheres from fly ash from the viewpoint of its heat-resisting property, sphericity and cost.

When the particle size of the glass balloons is less than 50 micrometers, the molten metal flow capability decreases which prolongs the molding time. When a particle size of the glass balloons is more than 200 micrometers, the strength of the lightweight and low thermal expansion composite material decreases.

Relationships between particle sizes of the glass balloons and shell thicknesses thereof are shown in FIG. 1. The following can be understood from the figure: As the particle size of the glass balloons increases, the shell thickness of the glass balloons becomes less uniform and shell thickness differences develop at various portions of the glass balloons. Accordingly, the larger the glass balloons become, the more likely they are to fracture during molding. For example, the lightweight and low thermal expansion composite materials of the present invention were produced by a pressurizing impregnation method, in which an injection pressure of 60 kgf/cm$^2$ was applied and the particle sizes of the glass balloons were varied. The relationship between the particle sizes of the glass balloons and the fracture rates thereof was observed. This relationship is shown in FIG. 2. As shown in this figure, when the particle size of the glass balloons is more than 200 micrometer the fracture rate thereof is more than about 25%, which is an undesirable value.

Here, the fracture rate of the glass balloons was obtained by observing a cross-section of the produced composite materials which was magnified with a microscope. The numbers of unbroken glass balloons and broken glass balloons in the cross-section were counted. The glass balloons had particle sizes falling within the predetermined particle size ranges. In observing the material with the microscope, the unbroken glass balloons were observed as solid circles in black, and the broken glass balloons were observed as circles in white which were encircled by a black line. This is because the broken glass balloons have broken shells and are filled with the light alloy. Accordingly, the broken glass balloons appear white and the adjacent light alloy similarly appears white, and only their shell portions appear as black circular lines.

The globularness or globular factor of the glass balloons was obtained by observing a cross-section of the produced composite materials which was magnified with a microscope. As shown in FIG. 3, a maximum diameter (1) of the glass balloons and a minimum diameter (d) thereof were measured, a percentage ratio of the minimum diameter (d) to the maximum diameter (1) (i.e., $(d/1)\times 100$) was then calculated, and the percentage ratios were averaged and taken as the globularness. When the globularness of the glass balloons is less than 90%, the volume content of the glass balloons decreases in the lightweight and low thermal expansion composite material. Therefore, the specific gravity and the thermal expansion coefficient cannot be reduced as expected.

For example the lightweight and low thermal expansion composite material of the present invention was produced with glass balloons having an average particle size of 100 micrometers and A390 aluminum alloy (Si: 16.4%, by weight, Cu: 5.39%, by weight, Mg: 0.57% by weight, Fe: 0.24% by weight, Zn: 0.07% , by weight, Mn: 0.04% by weight, Ni: 0.03% by weight, and Al: balance) in order to observe a relationship between the globularnesses of the glass balloons and the glass balloon volume contents of the composite materials, a relationship between the globularnesses of the glass balloons and the specific gravities of the composite materials, and a relationship between the globularnesses of the glass balloons and the thermal expansion coefficients of the composite materials. The pressurizing impregnation method was employed in which an injection pressure of 60 kgf/cm$^2$ was applied. The relationships are shown in FIG. 4. As can be seen from the figure, when the globularness of the glass balloons is 90% or more, the glass balloon volume content (Vf) is about 50% or more, the specific gravity ($\rho$) is about 1.65 or less, and the thermal expansion coefficient ($\alpha$) is about $15.5\times 10^{-6}$/° C. or less.

Further, conventional lightweight and low thermal expansion composite materials were produced in the same manner as above-mentioned but with conventional "shirasu" balloons having an average diameter of 25 micrometers and including various irregular shapes, and similar relationships were observed. According to the observation, the specific gravity and the thermal expansion coefficient of the conventional composite materials cannot be reduced fully because the "shirasu" balloons have a globularness or globular factor of 70–78%.

It is more desirable that the lightweight and low thermal expansion composite material according to the present invention has a specific gravity of 1.7 or less and a thermal expansion coefficient of $15.5\times 10^{-6}$/° C. or less respectively in order to maximize its advantages.

As aforementioned, the lightweight and low thermal expansion composite material according to the present invention includes the glass balloons which have a particle size falling within the range of 50–200 micrometers and a globularness of 90% or more. Accordingly, the composite material operates as follows.

The lightweight and low thermal expansion composite material does not adversely affect the molten metal flowability, because the particle size of the glass balloons is not too small. The glass balloons cannot be broken during molding, because the particle size of the glass balloons is not too large.

Further, the operation efficiency of filling up a mold with the glass balloons can be improved, and the glass balloon volume content in the composite material can be improved as well, because the glass balloons have a substantially sphere-like shape. Accordingly, the composite material of the present invention has the minimum realizable specific gravity and thermal expansion coefficient.

As previously described in detail, the lightweight and low thermal expansion composite material according to the present invention includes glass balloons which have a particle size in the specified range, and which have a substantially sphere-like shape. Hence, the composite material provides the following advantages.

The overall production efficiency of the composite material can be improved, because a mold can be filled up with the glass balloons with ease and the molten metal flowability is correspondingly improved.

Further, the specific gravity and the thermal expansion coefficient of the composite material can be fully minimized because the glass balloons are less likely to fracture during molding; and because the glass balloon volume content of the composite material is increased.

Furthermore, the physical properties of the composite material can be improved, because the shapes of the glass balloons are made uniform and because the light alloy is prevented from being disposed unevenly. The unevenly disposed light alloy occurs because of the fracture of the glass balloons.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS OF THE INVENTION

Having generally described the present invention, a further understanding can be obtained by reference to a certain specific preferred embodiment which is provided herein for purposes of illustration only and is not intended to be limiting unless otherwise specified.

Figure 1:
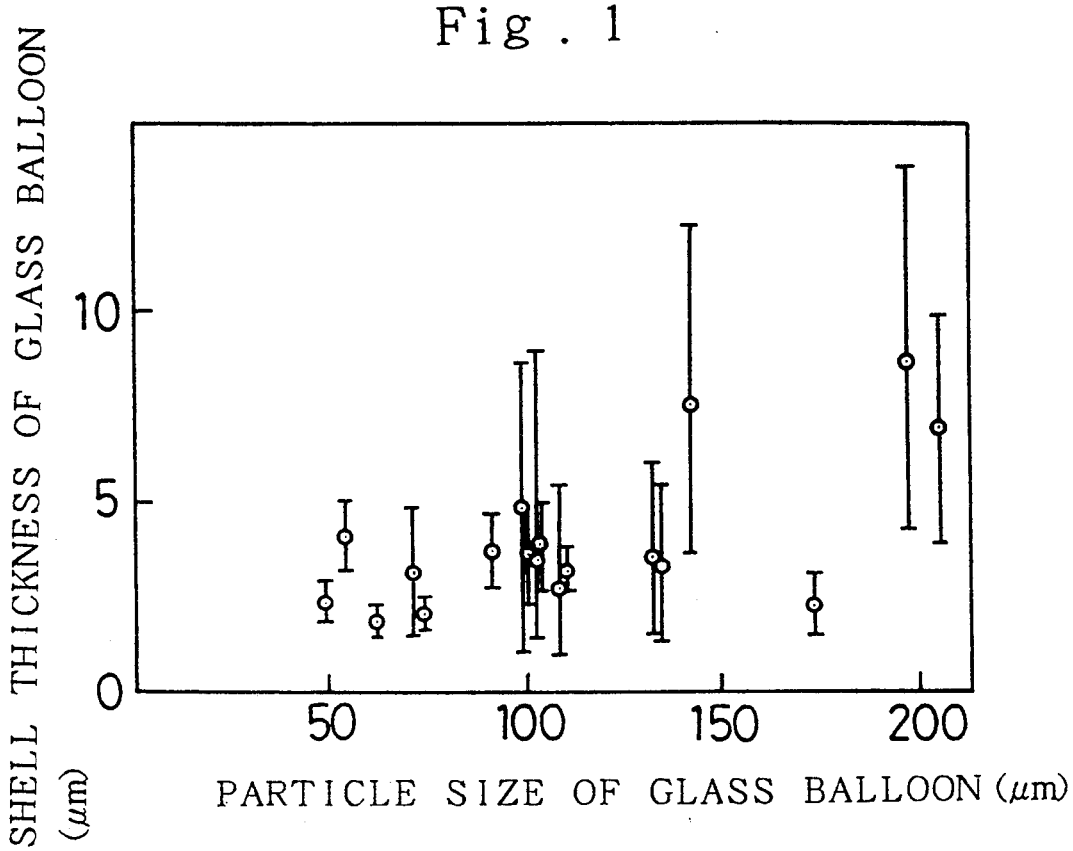
FIG. 1 is a graph showing relationships between particle sizes of glass balloons and shell thicknesses of the glass balloons.
Figure 3:
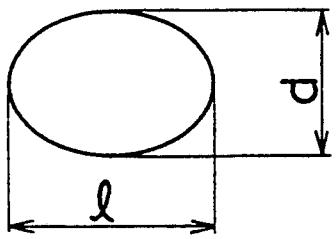
FIG. 3 is a diagram for explaining how to measure a globularness of the glass balloons.
Figure 2:
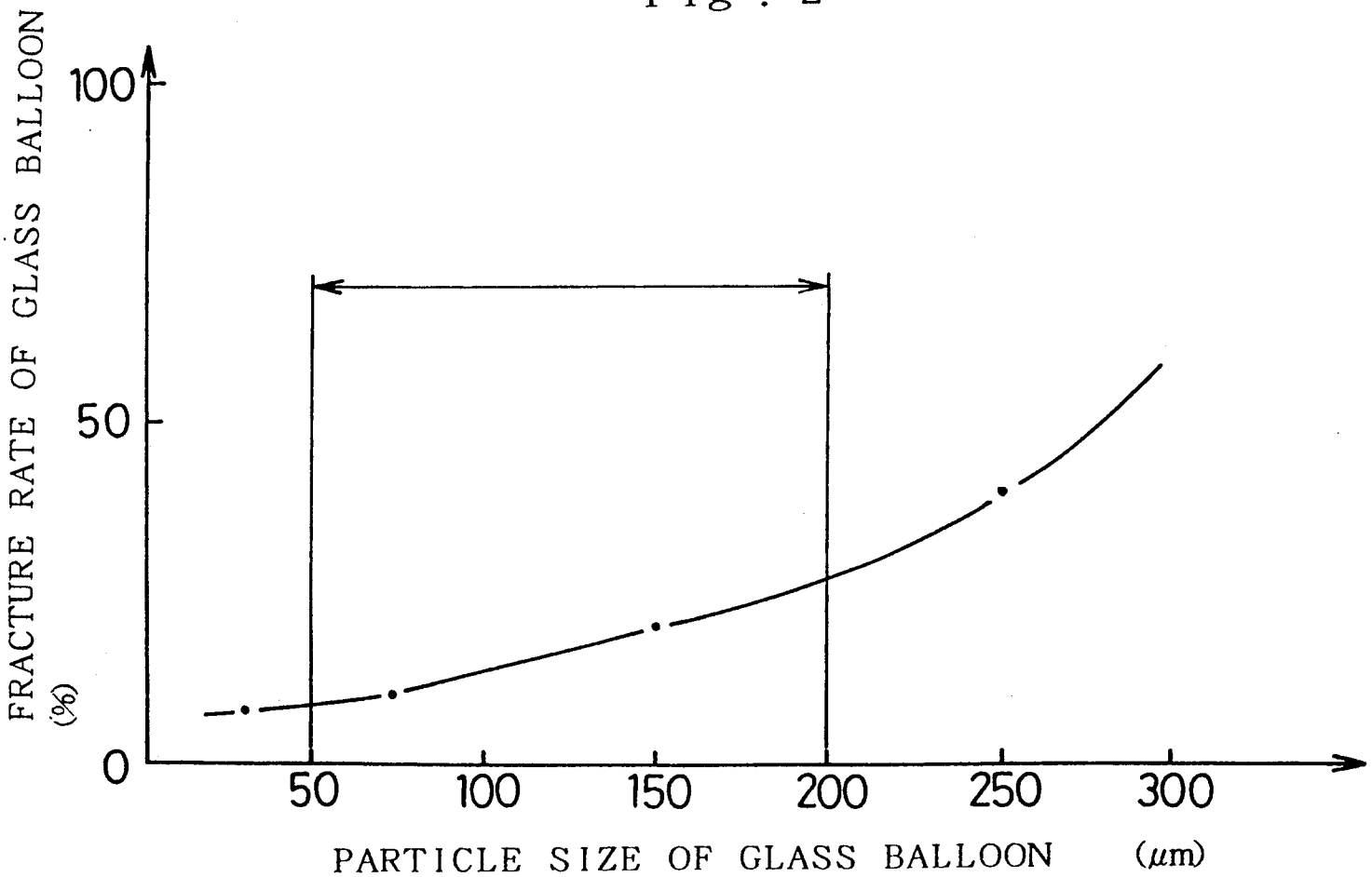
FIG. 2 is a graph showing a relationship between particle sizes of glass balloons and fracture rates of the glass balloons.
Figure 4:
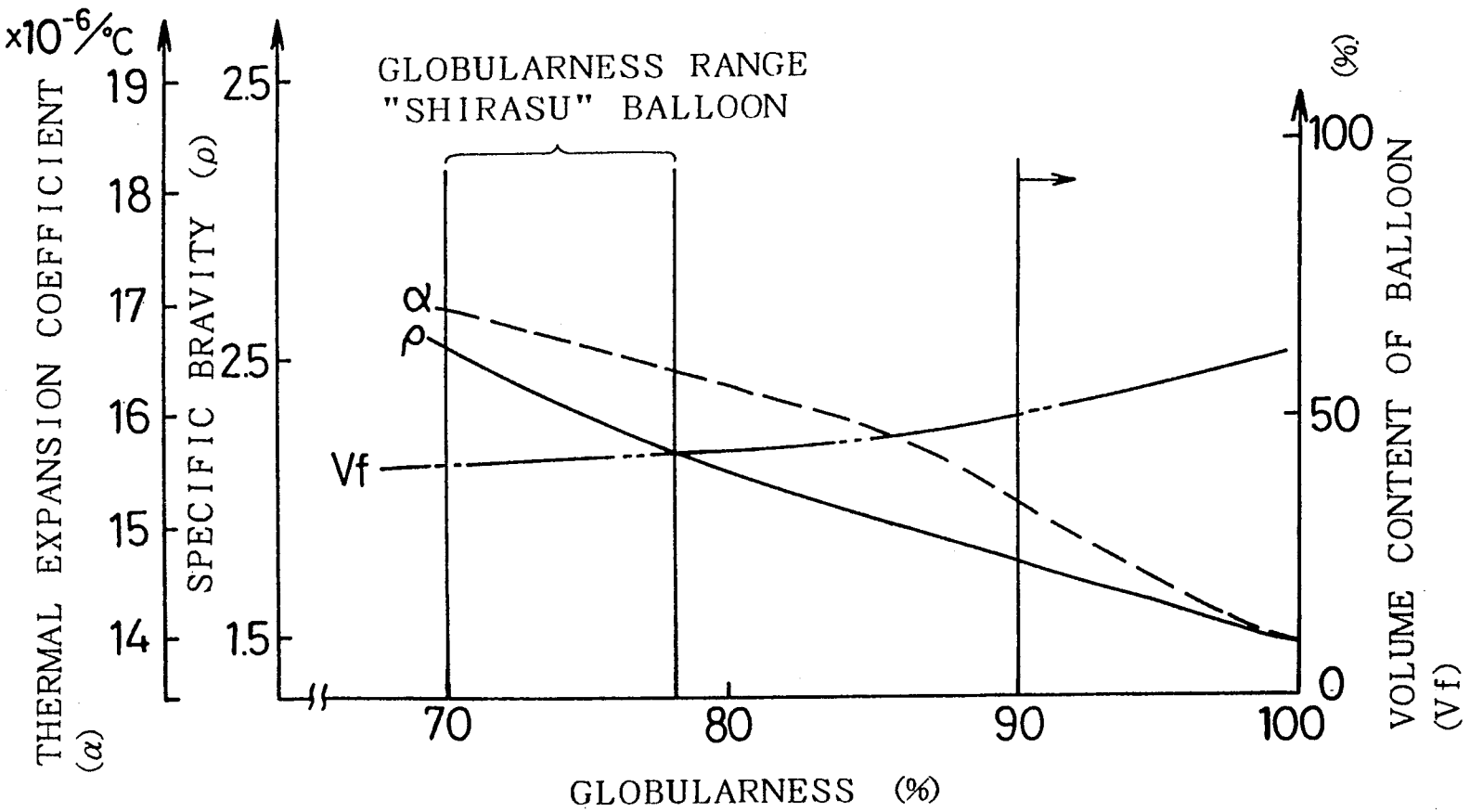
FIG. 4 is a graph showing a relationship between globularnesses of glass balloons and glass balloon volume contents of lightweight and low thermal expansion composite materials according to the present invention, a relationship between the globularnesses and specific gravities of the composite materials, and a relationship between the globularnesses and thermal expansion coefficients of the composite materials.
Figure 5:
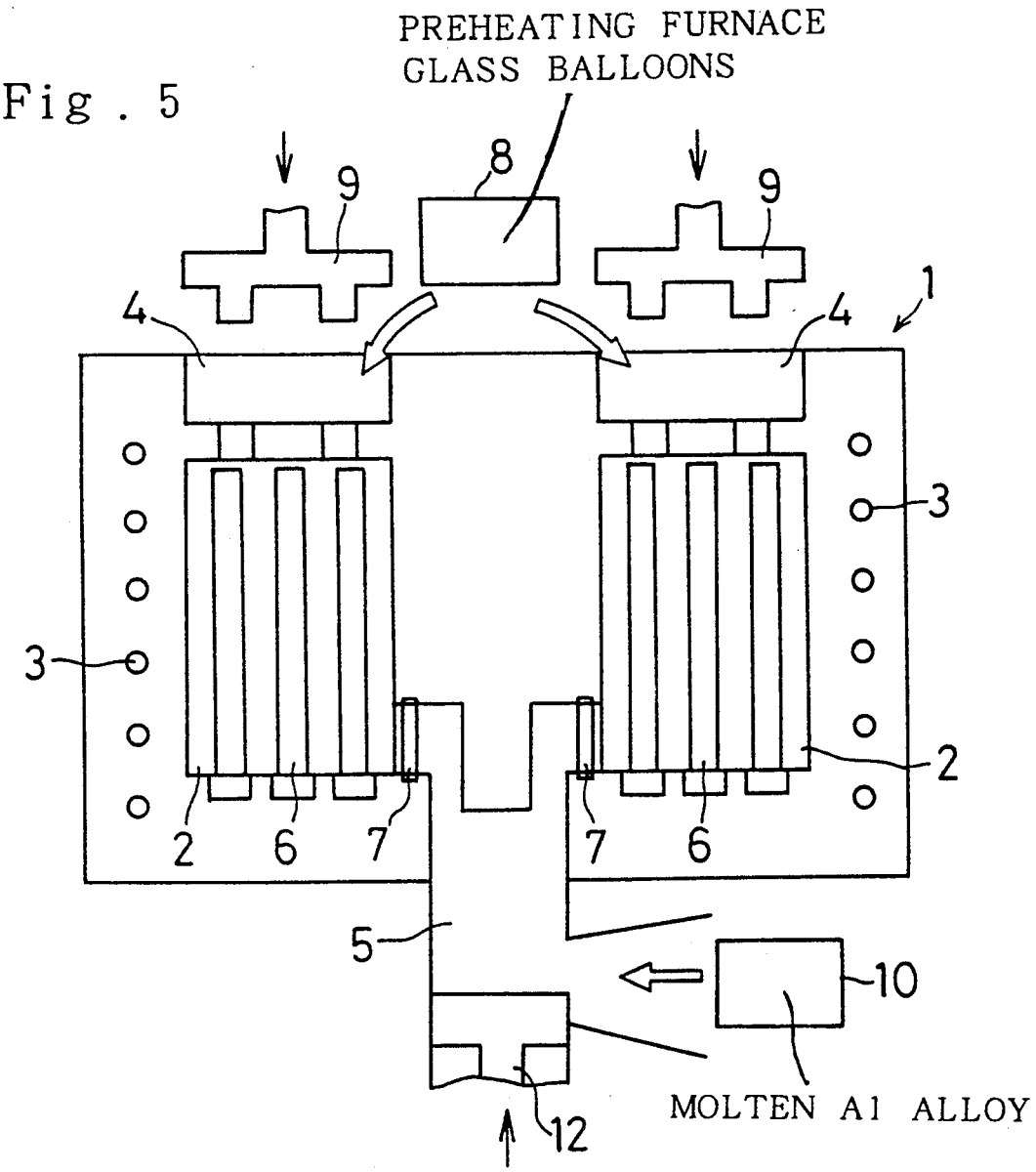
FIG. 5 is a diagram schematically illustrating a mold for producing a preferred embodiment of a lightweight and low thermal expansion composite material according to the present invention.

A lightweight and low thermal expansion composite material according to the present invention will be hereinafter described with reference to a preferred embodiment. The preferred embodiment of the composite material was produced by a pressurizing impregnation method which employed a mold 1 for a horizontal die-casting machine as illustrated in FIG. 5.

The mold 1 has two (2) cavities 2, 2 having a box shape of 50 mm×150 mm×180 mm, and built-in nichrome heaters 3, 3 on the both sides thereof. The upper portions of the cavities 2, 2 communicate with inlet ports 4, 4 for supplying glass balloons, and the lower portions thereof communicate with a gate 5.

After heating the mold 1 to about 400° C., cores 6, 6 made of iron were set in the cavities 2, 2, and metal fixtures 7, 7 made of a stainless steel wire gauze for fixing glass balloons were also set on the boundaries between the cavities 2, 2 and the gate 5. After clamping the mold 1, classified fly ash (trade name: SHOWA DENKO, "show" balloon, SL150; nominal grain size: 20–300 micrometers), which had a particle size falling within a range of 50–200 micrometers and a shell thickness of 4–6 micrometers, was preheated to about 400° C. in advance by a preheating furnace 8, and poured into the cavities 2, 2 through the inlet ports 4, 4. After the cavities 2, 2 of the mold I were filled up with the fly ash, the inlet ports 4, 4 were closed with sliding pins 9, 9. Under the above-mentioned circumstance, "A390" aluminum alloy was melted and heated to 800° C. by an electric furnace 10, and poured into the gate 5. The "A390" aluminum alloy included the following: Si: 16.4% by weight, Cu: 5.39% by weight, Mg: 0.57% by weight, Fe: 0.24% by weight, Zn: 0.07% by weight, Mn: 0.04% by weight, Ni: 0.03%, by weight, and Al: balance. Thereafter, the molten "A390" aluminum alloy was injected into the cavities 2, 2 at a flow velocity of 0.10 m/second at the gate 5 by an injection pressure of 60 kgf/cm$^2$ with a plunger 12, thereby pressure-molding the preferred embodiment of the lightweight and low thermal expansion composite material.

Figure 8:
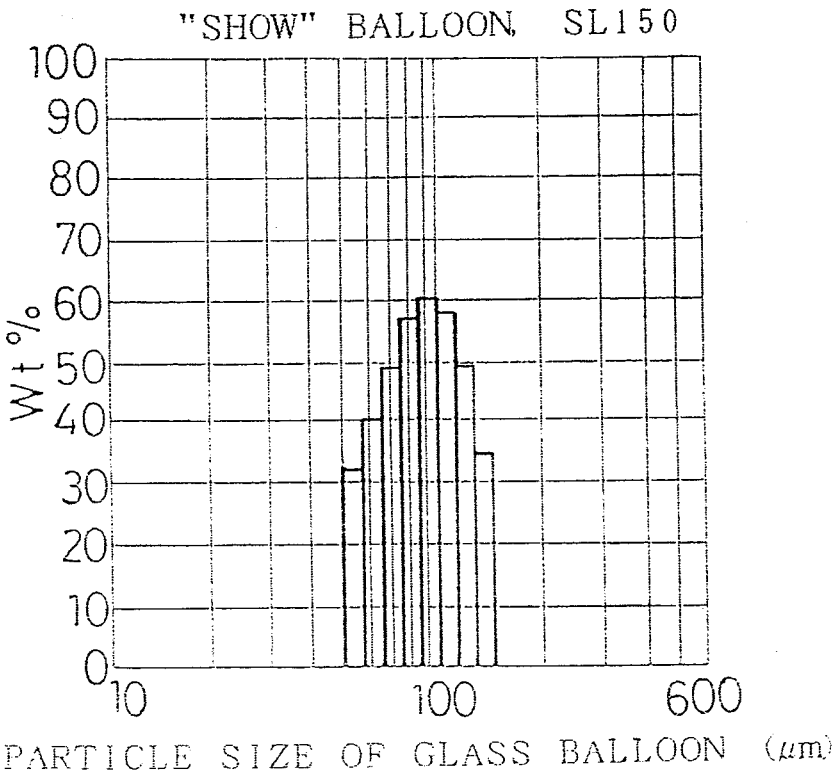
FIG. 8 is a line chart showing the result of component analysis of glass balloons used in the preferred embodiment.
Figure 9:
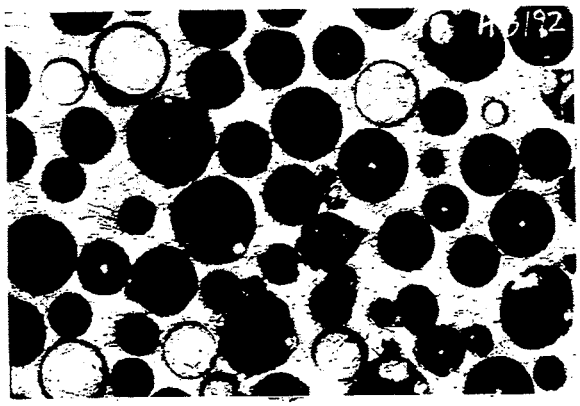
FIG. 9 is a microphotograph showing the cross-sectional particulate structure of the composite material.

Further, the result of component analysis of glass balloons used in this preferred embodiment is shown in the following Table, and the result of measuring particle size distribution of them is shown in FIG. 8. Furthermore, FIG. 9 is a microphotograph showing the cross-sectional particulate structure of the obtained composite material.

TABLE

| Component (wt %) | | | |
|---|---|---|---|
| $SiO_2$ | $Al_2O_3$ | $Fe_2O_3$ | $TiO_2$ |
| 58.0 | 40.2 | 0.3 | 1.5 |

A cross-section of the thus produced preferred embodiment of the lightweight and low thermal expansion composite material was magnified and observed with a microscope as aforementioned. As a result, an average value of the globularness of the glass balloons was 93%. Further, the preferred embodiment of the composite material had a specific gravity of about 1.62, and a thermal expansion coefficient of about $15\times10^{-6}$/° C. Thus, it was found that the specific gravity and the thermal expansion coefficient were minimized. In addition, the composite material had a tensile strength of about 6.3 kgf/mm$^2$, and accordingly it was a satisfactory material in view of the strength.

Figure 6:
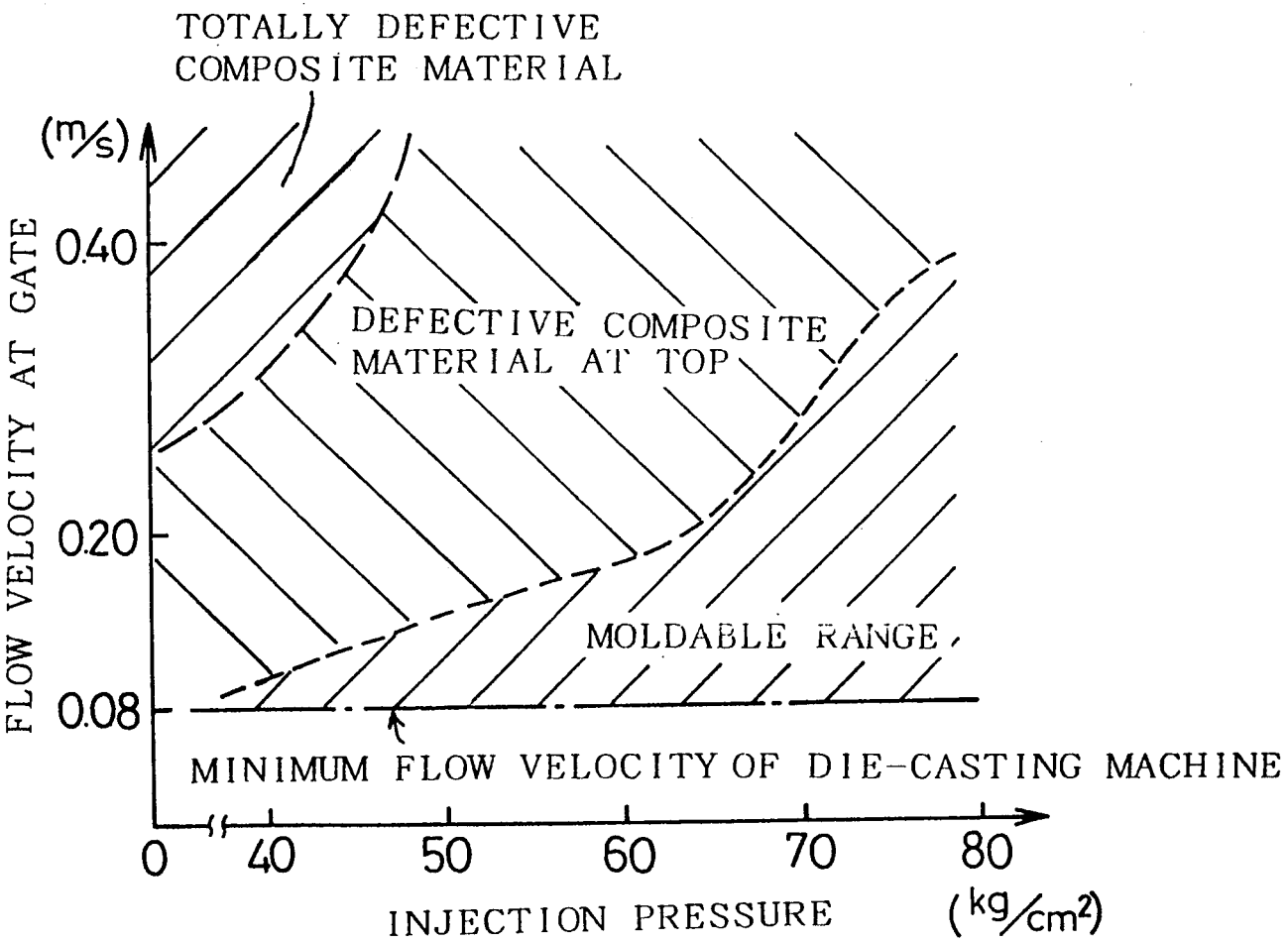
FIG. 6 is a diagram for specifying a moldable range for the preferred embodiment obtained from relationships between injection pressures and flow velocities at gate.
Figure 7:
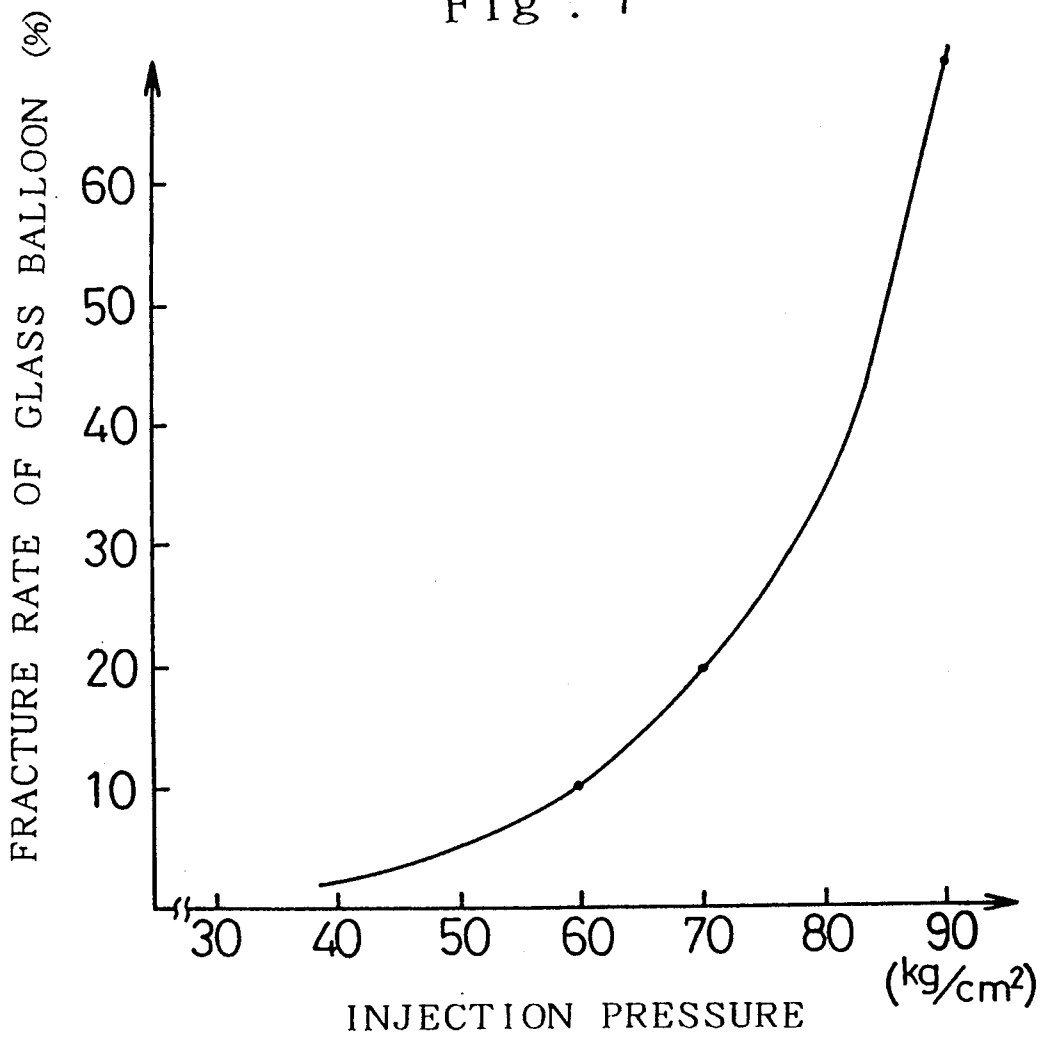
FIG. 7 is a graph showing a relationship between injection pressures and fracture rates of glass balloons.

Additionally, a moldable range, where the preferred embodiment of the lightweight and low thermal expansion composite material according to the present invention was moldable, was obtained from relationships between injection pressures and the f low velocities at the gate 5. FIG. 6 shows the moldable range. Further, a relationship between the injection pressures and fracture rates of the glass balloons was obtained for the case where the flow velocity was fixed at 0.12 m/second at the gate 5. FIG. 7 shows the relationships. According to the figures, it is desirable that the injection pressure falls within a range of 40–80 kgf/cm$^2$ in order to decrease the fracture rate in the pressurizing impregnation method, and it is more desirable that the injection pressure falls within a range of 50–60 kgf/cm$^2$. Likewise it is desirable that the flow velocity is 0.08–0.20 m/second at the gate 5.

Having now fully described the present invention, it will be apparent to one of ordinary skill in the art that many changes and modifications can be made thereto without departing from the spirit or scope of the present invention as set forth herein.

What is claimed is:

1. A method of forming a metallic composite product having a specific gravity no greater than 1.8 and a thermal expansion no greater than $16\times10^{-6}$/° C., in a mold preheated to a temperature of approximately 400° C., the mold having a cavity with one portion of the cavity in communication with an inlet port of the mold and another portion of the cavity spaced from said one portion in communication with a gate of the mold at a boundary of the cavity, said method comprising:

placing a porous metallic fixture between said another portion of the cavity and the gate at the boundary of the cavity for retaining particles in the cavity;

preheating screened hollow glass spheres derived from fly to a temperature substantially equal to the temperature of the preheated mold, said hollow spheres having a particle size in the range of approximately 50 to 200 micrometers and a globularness of at least 90 percent;

filling the cavity through the inlet port with the preheated screened hollow glass spheres;

filling interstices between the screened hollow glass spheres with a molten aluminum alloy injected through the gate and the porous metallic fixture into the cavity of the preheated mold, the step of filling including injecting the molten aluminum alloy at a pressure in the range of from 40 to 80 $kgf/cm^2$ at the gate and at a flow velocity in the range of 0.08 to 0.20 m/s; and permitting the aluminum alloy to solidify.

2. The method according to claim 1, wherein said aluminum alloy contains Si, Cu, Mg, Fe, Zn Mn, and Ni.

3. The method of claim 1 wherein the hollow glass spheres are preheated prior to the step of filling.

4. The method of claim 1, wherein the placing of porous metallic fixture includes placing of a piece of stainless steel wire gauze.

5. The method according to claim 1, wherein said product is a pump rotor of an automobile supercharger.

* * * * *

UNITED STATES PATENT AND TRADEMARK OFFICE

CERTIFICATE OF CORRECTION

PATENT NO. : 5,259,435

DATED : November 9, 1993

INVENTOR(S) : Hirohisa Miura et al.

It is certified that error appears in the above-indentified patent and that said Letters Patent is hereby corrected as shown below:

Claim 1, column 6, line 67, after "fly" insert insert --ash--.

Signed and Sealed this

Twenty-third Day of August, 1994

Bruce Lehman

*Attest:*

BRUCE LEHMAN

*Attesting Officer*

*Commissioner of Patents and Trademarks*